United States Patent [19]

Romic

[11] 4,114,931

[45] Sep. 19, 1978

[54] KNOTTING DEVICE

[75] Inventor: Ivica Romic, Mőnchen-Gladbach, Germany

[73] Assignee: W. Schlafhorst & Co., Mönchen-Gladbach, Germany

[21] Appl. No.: 857,704

[22] Filed: Dec. 5, 1977

[30] Foreign Application Priority Data

Dec. 4, 1976 [DE] Fed. Rep. of Germany ..... 2655042

[51] Int. Cl.[2] ..... B65H 69/04

[52] U.S. Cl. ..... 289/2; 289/5

[58] Field of Search ..... 289/2, 5, 12, 18

[56] References Cited

U.S. PATENT DOCUMENTS

| | | | |
|---|---|---|---|
| 2,264,784 | 12/1941 | Abbott | 289/2 |
| 3,110,511 | 11/1963 | Gebald et al. | 289/12 |
| 3,166,346 | 1/1965 | Gotz | 289/2 |
| 3,298,726 | 1/1967 | Francis | 289/2 |
| 3,495,860 | 2/1970 | Messa | 289/18 |
| 3,868,133 | 2/1975 | Franzen | 289/2 |
| 3,889,990 | 6/1975 | Messa | 289/5 |

FOREIGN PATENT DOCUMENTS

| | | | |
|---|---|---|---|
| 2,426,140 | 2/1975 | Fed. Rep. of Germany | 289/2 |

*Primary Examiner*—Louis K. Rimrodt
*Attorney, Agent, or Firm*—Herbert L. Lerner

[57] ABSTRACT

In a tying device for knotting together respective ends of two threads extending in opposite directions and having two tying jaws rotatable in opposite directions and disposed mutually opposing and laterally offset from one another, a cup wheel toothed at a rim thereof and meshing with drive pinions of the tying jaws, the cup wheel having entrainers disposed at varying levels for introducing and guiding the thread ends, and serving for driving the tying jaws, a longitudinally shiftable stripper for the knotted thread disposed in the center of the cup wheel, and two thread clamping devices disposed outside the cup wheel each of the thread clamping devices disposed outside the cup wheel, each of the thread clamping devices being controllable and having multiple looping clamps formed with threading contours, a device for equalizing and limiting bearing pressure at looping locations thereof, and a control device includes a pivotally mounted, controllable two-armed lever having a longer and a shorter lever arm, the longer arm carrying the multiple looping clamps at a free end thereof, and means for transmitting control movements to the shorter arm.

7 Claims, 15 Drawing Figures

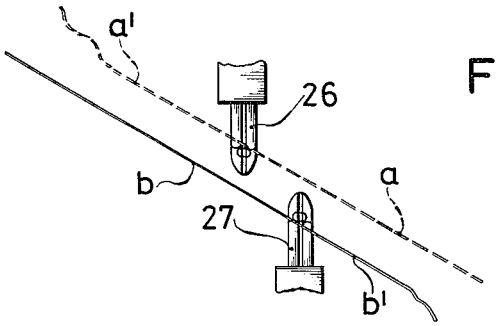
FIG. 6
FIG. 7
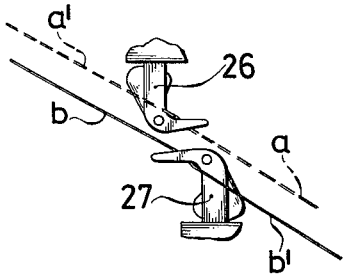
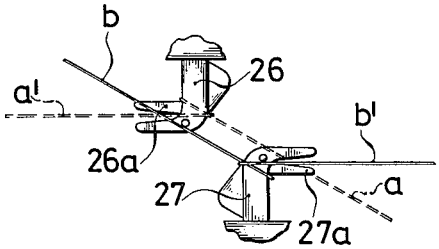
FIG.8
FIG.9
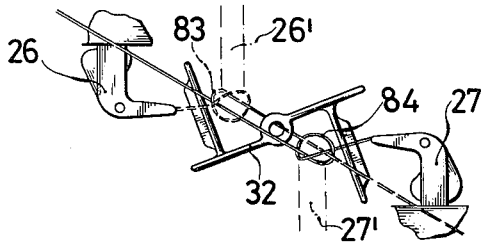
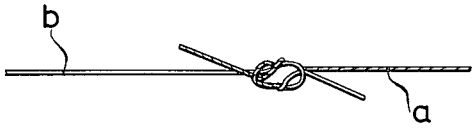
FIG.10

KNOTTING DEVICE

The invention relates to a tying or knotting device for knotting together or tying a pair of thread ends extending in opposite directions, using two tying jaws rotatable in opposite directions and disposed mutually opposing and laterally offset from one another, a cup wheel toothed at a rim thereof and meshing with drive pinions of the tying jaws, the cup wheel having entrainers disposed at varying levels for introducing and guiding the thread ends and serving for driving the tying jaws; a longitudinally shiftable stripper for the knotted thread disposed in the center of the cup wheel; and two thread clamps disposed outside the cup wheel.

Such tying or knotting devices are known, for example, for forming a fisherman's knot. The tying jaws of this heretofore known tying or knotting device serve not only for tying the knot but also for servering the excess thread length and for holding fast the short thread ends of the knot, which permits the completion of the knot formation and then facilitates tightening of the knot. For this purpose, the tying jaws carry controllable thread clamping shears.

The heretofore known tying devices, however, are not universally usable. Tying or knotting heavy or thick threads presents difficulties, since considerable forces must be exerted, whereby the thread ends slide out of the thread clamps since the latter cannot at all accommodate thick or heavy threads, and because the friction forces become so large when the knot is being tightened that the stripper tears the tied or knotted thread apart, or because the especially long and numerous waste fibers of the thick or heavy threads accumulate in the largely closed tying or knotter head and cannot be removed therefrom without difficulty.

It is accordingly an object of the invention to provide a tying or knotting device which also affords the tying of thick or heavy threads, which is usable for thin or light as well as for thick or heavy threads and permits thin or heavy threads to be held fast selectively by the thread clamps in a secure and gentle manner.

With the foregoing and other objects in view, there is provided in accordance with the invention, in a tying device for knotting together respective ends of two threads extending in opposite directions and having two tying jaws rotatable in opposite directions and disposed mutually opposing and laterally offset from one another, a cup wheel toothed at a rim thereof and meshing with drive pinions of the tying jaws, the cup wheel having entrainers disposed at varying levels for introducing and guiding the thread ends, and serving for driving the tying jaws, a longitudinally shiftable stripper for the knotted thread disposed in the center of the cup wheel, and two thread clamping devices disposed outside the cup wheel, each of the thread clamping devices being controllable and having multiple looping clamps formed with threading contours, a device for equalizing and limiting bearing pressure at looping locations thereof, and a control device comprising a pivotally mounted, controllable two-armed lever having a longer and a shorter lever arm, the longer arm carrying the multiple looping clamps at a free end thereof, and means for transmitting control movements to the shorter arm.

By looping each of the two threads around several times, the required bearing pressure can be reduced.

In accordance with another feature of the invention, the longer lever arm surrounds substantially half the periphery of the cup wheel, sensing means are carried by the shorter lever arm and spring biased into engagement with guide contours formed on the cup wheel for controlling the double-armed levers, the longer lever arm of both the control devices being also formed as a respective thread guiding wire projecting beyond the cup wheel and the tying jaws.

In accordance with a further feature of the invention, the stripper is formed as a triple fork with four fork tines and including one outer fork disposed behind one of the tying jaws which is located downstream in thread travel direction through the tying device, another outer form disposed forward of the other of the tying jaws which is located upstrem in thread travel direction, and a middle fork disposed between the two tying jaws and the fork tines being formed with thread guiding contours for guiding the thread ends during the knotting operation.

In accordance with an added feature of the invention, each of the two tying jaws has a backwardly opening and controllable clamping shear blade cooperating about a pivot scissors-like with a stationary blade as well as a clamping jaw, the clamping shear blade having a tip and being formed with a hump at a side thereof facing away from the tip and located behind the scissors-like pivot, the hump, in closed condition of the tying jaws, being located within the outer contours of the respective clamping jaw and stationary blade and, in open condition of the tying jaws, projecting outwardly beyond the outer contours.

In accordance with an additional feature of the invention, each of the two tying jaws has a backwardly opening and controllable clamping shear blade member cooperating scissors-like with a stationary clamping jaw member, the cooperating clamping shear blade member and clamping jaw member being formed with two cooperating thread clamping surfaces at least one of which is fluted, the fluting thereof increasing and becoming coarser in direction toward the tip of the respective clamping member whereon it is formed.

In accordance with yet another feature of the invention, the fluting is in the form of teeth.

In accordance with a concomitant feature of the invention, the fluted thread clamping surface is formed on the stationary clamping jaw member.

Because the longer lever arm surrounds approximately one-half the periphery of the cup wheel, the opening travel of the thread clamp is increased in the extreme and is especially well suited for accommodating heavy or thick threads.

By constructing the longer lever arms of the control devices as thread guide wires, it becomes unnecessary to provide a casing formed with guide contours for enclosing the head of the tying device. The thread guide wires prevent dust and waste fibers from settling, and cleaning of the tying device with compressed air or the like is made possible or facilitated. The construction of the stripper as a multiple fork permits, firstly, the formation of multiple guide surfaces for guiding the thread ends during the tying operation and, secondly, gripping of the knotted thread, which is to be stripped off the tying jaws at several locations in front of and behind the tying jaws. This reduces the friction between the loop of the knot and the tying jaw because it is no longer possible to skew the loop of the knot on the tying jaw when stripping it off.

Other features which are considered as characteristic for the invention are set forth in the appended claims.

Although the invention is illustrated and described herein as embodied in knotting device, it is nevertheless not intended to be limited to the details shown, since various modifications structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIGS. 6 to 9 are fragmentary diagrammatic top plan views of the tying device of FIG. 1 depicting different phases of the tying operation;

FIG. 10 is a view of the knot tied in the operation shown in FIGS. 6 to 9;

Figure 1:
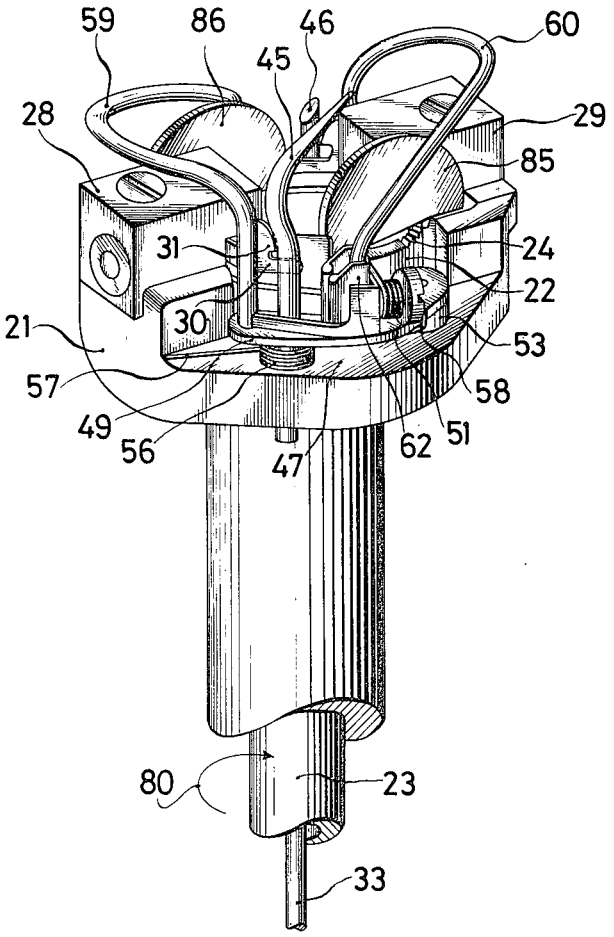
FIG. 1 is a perspective view of the knotting or tying device of the invention.
Figure 11:
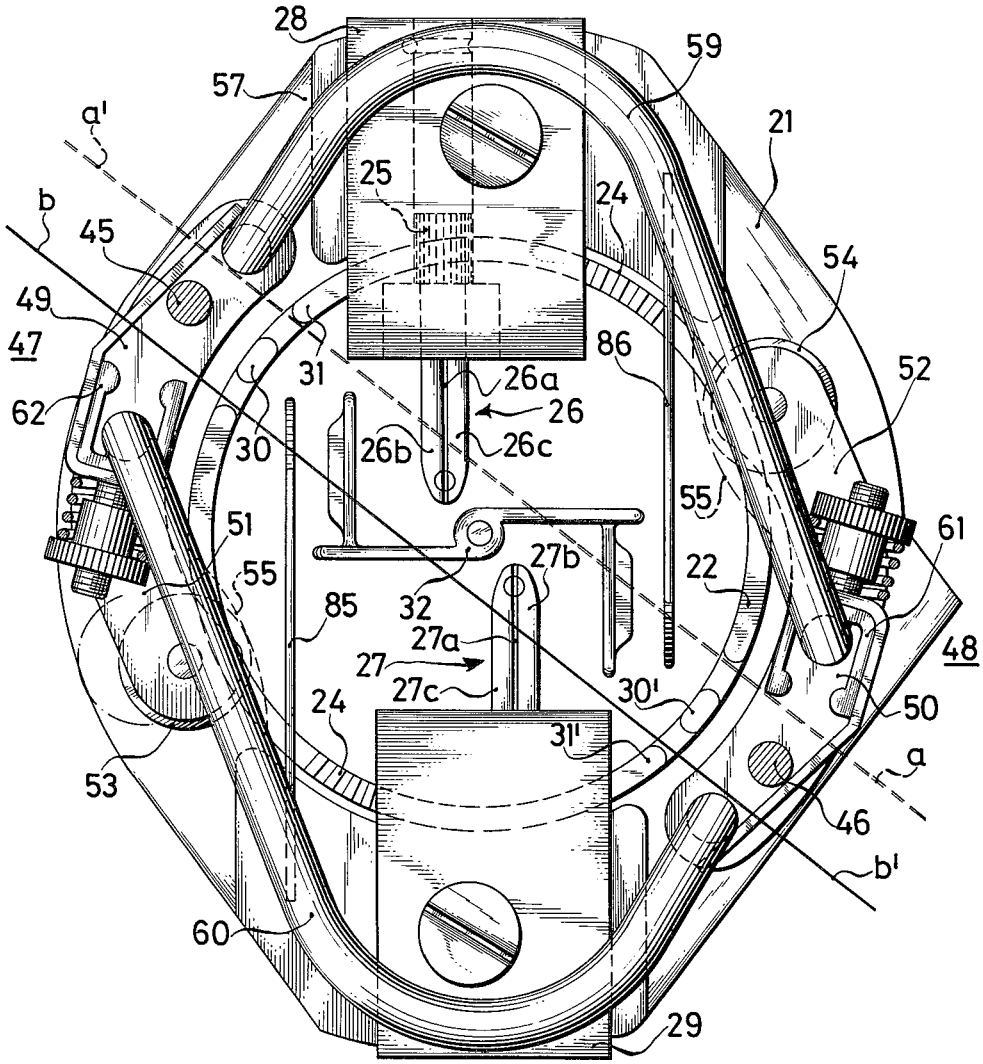
FIGS. 11 and 12 are enlarged top plan views of the tying device of FIG. 1 showing cup wheels and tying jaws thereof in different phases of operation.
Figure 12:
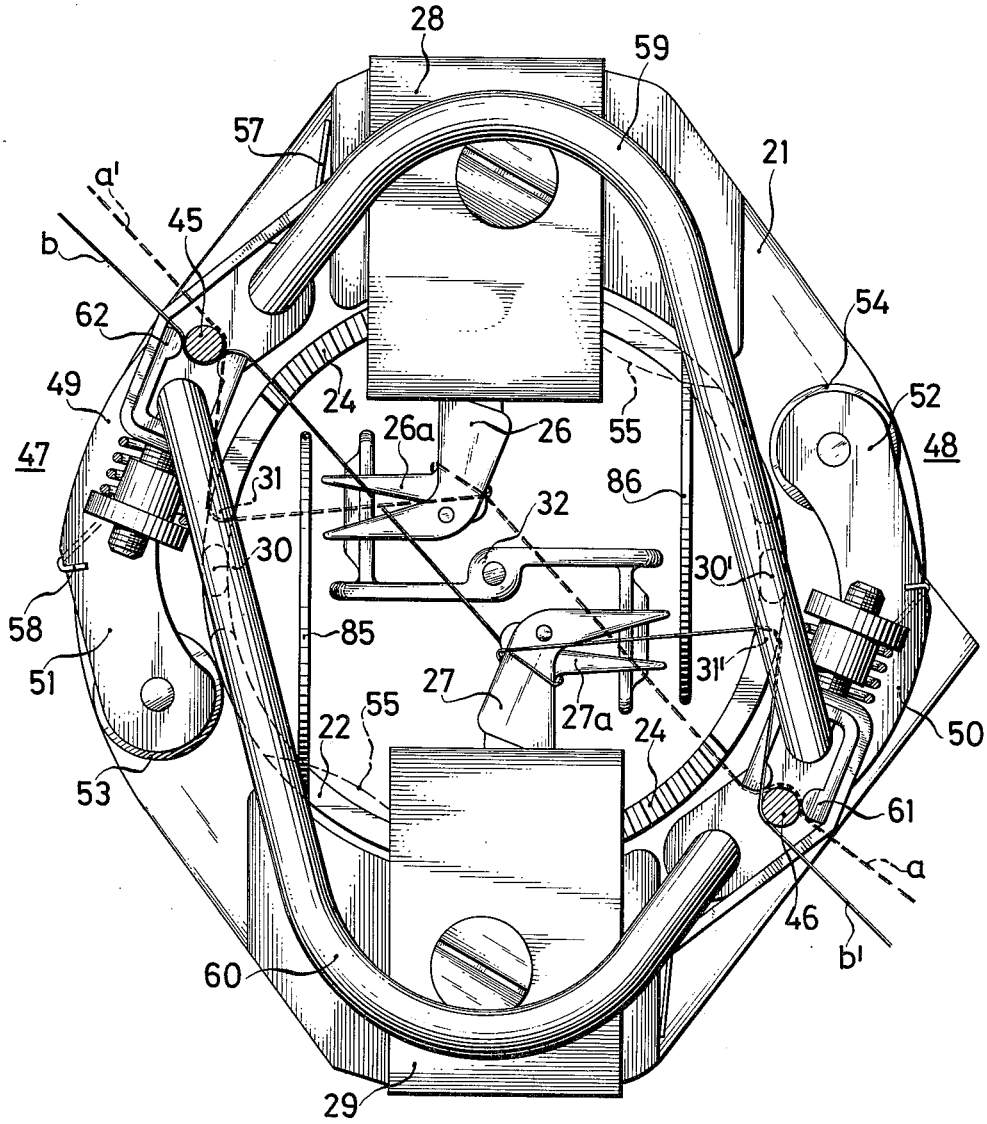

Referring now to the drawings and first, particularly, to FIGS. 1, 11 and 12 there is shown a housing 21, in which a cup wheel 22 is rotatably mounted. A hollow shaft 23 connected to the cup wheel 23 is, in turn, mounted in the housing 21 and can be rotated by a non-illustrated drive mechanism, where required. The upper edge of the cup wheel 22 carries, on two opposite parts of the periphery thereof, teeth 24 which mesh with drive pinions 25 (FIG. 11) of two tying jaws 26 and 27. The tying jaws 26 and 27 are supported in housings 28 and 29, respectively, which are fastened to the housing 21. The tying jaws 26 and 27 and the housings 28 and 29 thereof are disposed opposite to and laterally offset from one another. The cup wheel 22 additionally has, at two opposite locations thereof, two entrainers 30 and 31, respectively, which are disposed at different heights to facilitate the insertion and guidance of the thread ends as well as to entrain the threads when the cup wheel 22 is rotated.

Figure 4:
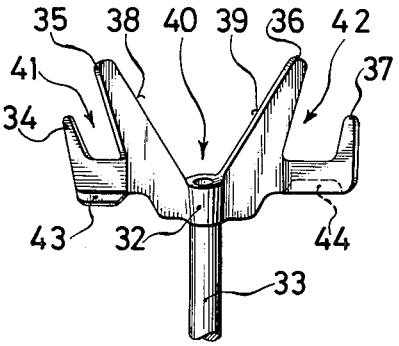
FIG. 4 is a side elevational view of a stripper forming part of the tying device.
Figure 5:
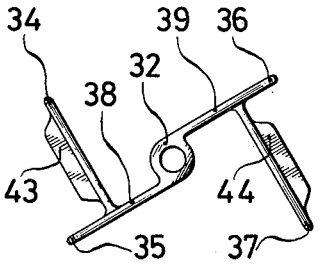
FIG. 5 is a top plan view of FIG. 4.

In the center of the cup wheel 22, a stripper 32 is disposed so as to be in longitudinal direction of the cup wheel. The stripper 32 is mounted at the end of a forked rod 33, which extends through the hollow shaft 23. The stripper 32 can be seen especially clearly in FIGS. 4 and 5 of the drawing and is constructed as a triple fork with four fork tines 34, 35, 36 and 37. The fork tines 35 and 36 are provided with thread guiding contours 38 and 39 for guiding the thread ends during the tying or knotting operation. The triple fork is formed by a middle fork 40 and the two outer forks 41 and 42, which are offset by 90° relative to the middle fork, as seen particularly in FIG. 5. Below the forks 41 and 42, as shown in FIG. 4, horizontal baffles 43 and 44, respectively, are disposed and serve to reinforce the forks but also, like the forks per se, serve to support the tied or knotted threads when the loops of the knot are stripped off the tying jaws 26 and 27. The fork tines 35 and 36 of the middle fork 40, laterally offset from one another, as shown in FIG. 5 especially, are radially attached to the end of the fork rod 33. This manner of disposition and attachment facilitates guidance and lifting of the tied or knotted thread from the tying jwas 26 and 27.

Outside of the cup wheel 22, at mutually opposing locations, thread guiding pins 45 and 46 are provided, which are supported in the housing 21 with a narrowly limited angle of rotation and, respectively, carrying a control device 47, 48. Each of these control devices 47 and 48 has a two-armed lever or bell crank 49 and 50, respectively.

The shorter lever arm 51 of the lever 49 has a feeler or sensing element 53, and the shorter lever arm 52 of the lever 50, a feeler or sensing element 54. The feeler or sensing elements 53 and 54 are formed of respective rollers which are rotatably mounted on the ends of the respective lever arms 51 and 52. The feeler or sensing elements 53 and 54 are biased by spring force against guide profiles 55, which are disposed at mutually opposing locations at the outer wall of the cup wheel 22. This spring force is exerted by wound spiral springs 56 (FIG. 1) which are looped around the thread guiding pins 45 and 46 beneath the levers 49 and 50. As seen in FIG. 12 the wound spiral spring 56 has ends 57 and 58 protruding from beneath the lever 49.

The longer lever arm of the bellcrank lever 49 extends around the cup wheel 22 somewhat over half of the periphery thereof and is simultaneously formed as a thread guiding wire 59 protruding beyond the cup wheel 22 and the tying jaws 26. Similarly, the longer lever arm of the lever 50 extends around more than half the periphery of the cup wheel 24 and is likewise formed as a thread guiding wire 60 projecting beyond and above the cup wheel 22 and the tying jaws 27.

The thread guiding wire 59 carries at the end thereof a multiple looping-clamp 61, and the thread guiding wire 60 at the end thereof a multiple looping clamp 62. Both multiple looping clamps 61 and 62 are of the same construction and are shown in greater detail in FIGS. 2, 3 and 3*a*.

Figure 2:
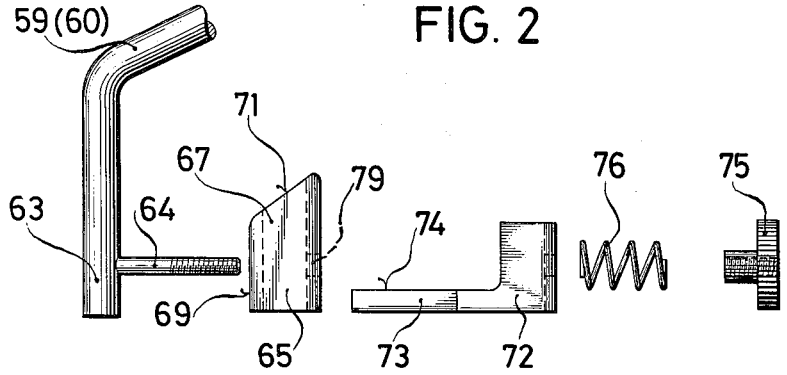
FIG. 2 is an exploded side elevational view of a multiple-looping clamp forming part of the tying device.
Figure 3:
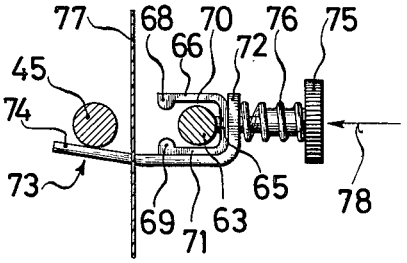
FIGS. 3 and 3a are top plan views of the clamp of FIG. 2 in assembled condition thereof and showing the clamp in two phases of operation thereof.
Figure 3A:
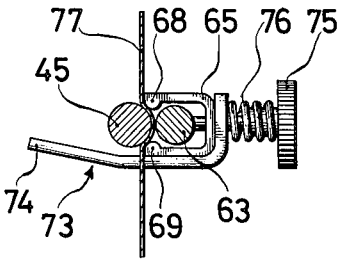

In FIGS. 2, 3 and 3*a*, there is shown at the end of the thread guiding wires 59 and 60, respectively, an externally threaded pin 64 which is secured perpendicularly, as by welding, to the end section 63 of the respective thread guiding wire 59, 60 and onto which a thread clamping member 65 having a U-shaped bend is threaded. In the threaded-on condition of the clamping member 65, the side walls 66 and 67 of the clamping member 65 surround the end section 63 of the respective thread guiding wires 59 and 60 so that the rounded, beadlike looping edges 68 and 69 extend beyond the respective guiding wire end section 63, as clearly shown in FIGS. 3 and 3*a*. The upper limit of the side walls 66 and 67 is bevelled and rounded and, in this manner, forms threading profiles 70, 71. An angular pressure member 72 is disposed over the thread clamping member 65 and has, at the base or foot thereof, an extension 73 which has, on the upper side thereof, also, a rounded threading profile 74. A compression spring 76 adjustable by a knurled nut 75 is also strung on the threaded stud 64.

In FIGS. 3 and 3*a*, there is further seen the thread guiding pin 45 of the tying device. If a thread 77 is now placed over the extension 73 and between the thread clamping member 65 and the thread guiding pin 45, and the end section 63 is moved in direction of the arrow 78 (FIG. 3), the thread 77 is clamped tight. This occurs due to looping of the thread 77 around the looping edges 68 and 69 of the clamping member 65, and around the thread guiding pin 45, as well as due to pressing of the thread 77 against the thread guiding pin 45 at two locations thereof at least. Since the hole 79 formed in the thread clamping member 65 has a larger diameter than that of the threaded pin or stud 64, the thread clamping member 65 is mounted movably in such a manner that the bearing pressure is uniformly distributed over the looping edges 68 and 69. The bearing pressure is equalized or balanced by the compression spring 76 in accordance with the spring characteristic and is also simultaneously limited in accordance with the adjustment of the knurled nut 75.

The tying or knotting operation proceeds as follows:

The threads *a* and *b* to be tied or knotted are placed into the tying or knotting device from the front in such a manner that the thread ends *a'* and *b'*, respectively, thereof, which are held bast outside the tying device, extend in different i.e. opposite directions (FIGS. 6 and 11). Each thread *a* and *b*, guided by the thread guiding wires 59 and 60, the thread guiding pins 45 and 46 and the thread baffles 85 and 86 is delivered into the hollow shaft 23 is then turned in direction of the arrow 80 (FIG. 1), the tying jaws 26 and 27 perform rotary motion in opposite directions (FIG. 7), grip the thread associated therewith and loop it around the respective other thread (FIGS. 12, 8, 9). This operation is facilitated by the provision that when the cup wheel 22 is rotated, the thread end *a'* is entrained by the entrainer 31 and is placed over the thread *b*. The same occurs with the thread end *b'*, which is entrained by the entrainer 31' and is disposed or placed over the thread *a* (FIG. 12). In the position of the tying jaws 26 and 27 according to FIGS. 8 and 12, the tying operation for forming a fisherman's knot is already virtually completed. Each tying jaw 26, 27 has up to then completed three quarters of a revolution, has formed a thread loop and has opened the clamping shear blades 26*a* and 27*a*, respectively, thereof. The clamping shears 26*a* are just about to grip the thread end *a'*, to sever it and to hold fast the newly produced thread end. The clamping shear blade 27*a* will do the same with the thread end *b'* upon further rotation of the hollow shaft 23. The end of the tying or knotting operation per se is shown in FIG. 9 in a drawn-out presentation. The tying jaws 26 and 27 have made one full revolution and the tips thereof are vertical again. For the sake of clarity, the tying bills are shown displaced laterally, whereas in reality they are in the position 26' and 27', respectively.

The stripper 32, with the forks thereof, has already lifted the two knot loops 83 and 84 off the tying jaws 26 and 27, while the tying jaws still hold the thread ends and pull them through the thread loop around the respective adjacent thread. If the stripper 32 is then still further advanced and thereby removed from the field of traverse of the tying jaws 26 and 27, the two knot loops contract and slide together to form a single knot, which is shown in FIG. 10. This occurs while the hollow shaft 23 is turned back in a rotary direction opposite the direction of the arrow 80, until the tying jaws 26 and 27 have reached the starting position thereof. Then, the tripper 32 also returns to the starting position thereof.

It is evident that during the entire tying or knotting operation, the threads *a* and *b* must be clamped tightly in the multiple looping-clamps 61 and 62, as is shown especially in FIG. 12. Immediately after the cup wheel 22 has started to turn, the feeler or sensing elements 53 and 54 run from the guiding contours 55 onto the outer surface of the cup wheel 22, whereby the multiple looping-clamps 47 and 48 close. They remain closed during the entire tying or knotting operation and are opened again only toward the end of the return motion of the tying jaws 26 and 27.

Figures 13, 14:
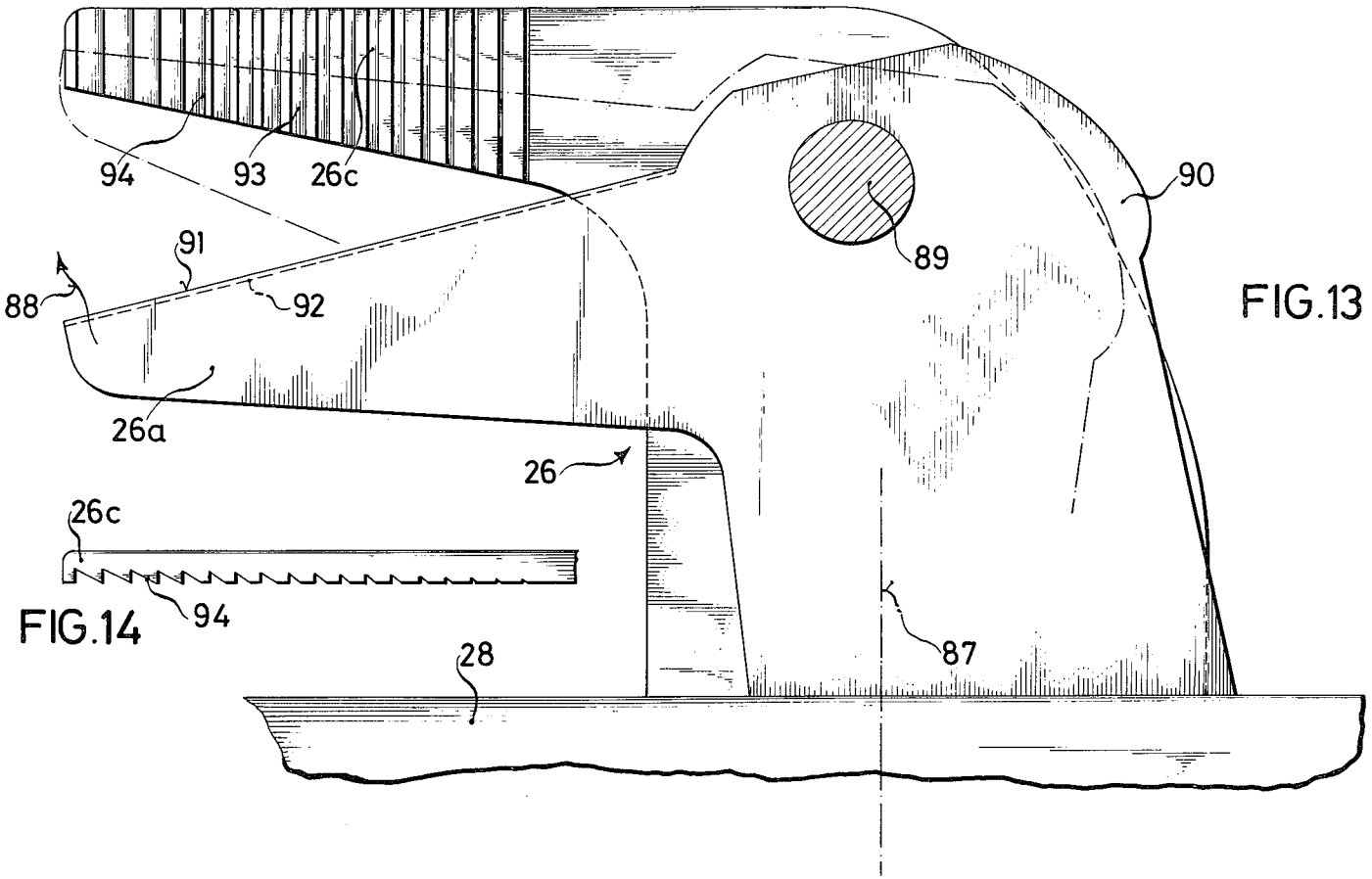
FIG. 13 is a much enlarged plan view of an individual tying bill such as is shown in FIG. 12.
FIG. 14 is a fragmentary top plan view of FIG. 13 showing the tip of one of the clamping jaws.

As can be seen from FIG. 11, the tying jaw 26 has a movable clamping shear blade 26*a*, which is disposed between a stationary blade 26*b* and a stationary clamping jaw 26*c*. Similarly, also the tying jaw 27 has a movable clamping shear blade 27*a* which is disposed between a stationary blade 27*b* and a stationary clamping jaw 27*c*. FIG. 13 shows in a greatly enlarged view, a fragment of the tying jaw 26 with a housing 28 therefor, the stationary clamping jaw 26*c* thereof and the movable clamping shear blade 26*a* thereof. The stationary blade 26*b* has been omitted from FIG. 13 in the interest of greater clarity. When the tying jaw 26 is pivoted about the axis 87 out of the starting position thereof shown in FIG. 11, the movable clamping shear blade 26*a* is controlled, by a non-illustrated eccentric within the housing 28, in such a manner that it begins to open after half a revolution of the tying jaw 26, is completely open after three-quarters of a revolution, as shown in FIG. 13, and is completely closed again after a complete revolution. In closing, the clamping shear blade 26*a* swings about the shears pivot 89 in direction of the arrow 88. The clamping shear blade 26*a* is to be opened backwards i.e. towards the housing 28, as viewed in FIG. 13. On the side opposite the tip of the blade, the clamping shear blade 26*a* has, behind the shears pivot 89, a hump 90 which projects beyond the contours of the stationary clamping jaw 26*c* when the tying jaw 26 is open, as shown in FIG. 13. When the tying jaw 26 is closed, however, the hump 90 retreats behind the outlines or contours of the clamping jaw 26*a*, as shown in phantom in FIG. 13. Since the contour of the stationary blade 26*b*, which is not shown in FIG. 13, coincides with that of the clamping jaw 26, the hump 90 has also retreated behind the outer contours of the stationary blade when the tying jaw 26 is closed. By means of the hump 90, the sliding of a thread loop from the tying jaw 26 before the thread end is gripped by the clamping shear blade 26*a* is prevented.

In the side view of FIG. 13, the viewer is looking at the thread cutting edge 91 of the clamping shear blade 26*a*. Behind the cutting edge 91, the thread clamping edge 92 of the blade 26*a* parallel to the thread cutting edge 91 is situated. The entire back of the blade 26*a* serves as the thread clamping surface. At the clamping jaw 26*c*, there is seen a thread clamping surface 93 which cooperates with the thread clamping surface of the blade 26*a* and is serrated. The serration is a sawtooth serration 94 which increases in size and becomes coarser toward the tip of the clamping jaw 26*c*. The tips of the sawteeth are directed backwards, as shown in FIG. 14, so that a gripped thread end can be held better. Thinner threads are gripped and held further back, where the serration is smaller and less coarse, and heavier or thicker threads farther forward, where the serration is larger and coarser.

In FIG. 13 it is furthermore apparent that the neck of the tying jaw 26 has an especially sturdy form. This sturdy form was chosen intentionally so that thread loops of very great diameter can be looped which are more advantageous for very coarse threads than are thread loops of smaller diameter.

The tying or knotting device according to the invention is especially suited for automatic winding machines. Advantages achieved with the invention of the instant application are, in particular, that one and the same tying or knotting device can be used for light (thin) and heavy (thick) threads; that this tying or knotting device is easy to clean and can also tie or knot coarse, heavy threads which were unable to be tied by mechanical tying or knotting devices heretofore.

There are claimed:

1. In a tying device for knotting together respective ends of two threads extending in opposite directions and having two tying jaws rotatable in opposite directions and disposed mutually opposing and laterally offset from one another, a cup wheel toothed at a rim thereof and meshing with drive pinions of the tying jaws, the cup wheel having entrainers disposed at varying levels for introducing and guiding the thread ends, and serving for driving the tying jaws, a longitudinally shiftable stripper for the knotted thread disposed in the center of the cup wheel, and two thread clamping devices disposed outside the cup wheel, each of the thread clamping devices being controllable and having multiple looping clamps formed with threading contours, a device for equalizing and limiting bearing pressure at looping locations thereof, and a control device comprising a pivotally mounted, controllable two-armed lever having a longer and a shorter lever arm, said longer arm carrying said multiple looping clamps at a free end thereof, and means for transmitting control movements to said shorter arm.

2. Tying device according to claim 1 wherein said longer lever arm surrounds substantially half the periphery of the cup wheel, sensing means carried by said shorter lever arm and spring-biased into engagement with guide contours formed on the cup wheel for controlling the double-armed levers, said longer lever arm of both said control devices being also formed as a respective thread guiding wire projecting beyond the cup wheel and the tying jaws.

3. Tying device according to claim 1 wherein the stripper is formed as a triple fork with four fork tines and including one outer fork disposed behind one of the tying jaws which is located downstream in thread travel direction through the tying device, another outer fork disposed forward of the other of the tying jaws which is located upstream in thread travel direction, and a middle fork disposed between the two tying jaws, and said fork tines being formed with thread guiding contours for guiding the thread ends during the knotting operation.

4. Tying device according to claim 1 wherein each of the two tying jaws has a backwardly opening and controllable clamping shear blade cooperating about a pivot scissors-like with a stationary blade as well as a clamping jaw, said clamping shear blade having a tip and being formed with a hump at a side thereof facing away from said tip and located behind said scissors-like pivot, said hump, in closed condition of said tying jaws, being located within the outer contours of the respective clamping jaw and stationary blade and, in open condition of said tying jaws, projecting outwardly beyond said outer contours.

5. Tying device according to claim 1 wherein each of the two tying jaws has a backwardly opening and controllable clamping shear blade member cooperating scissors-like with a stationary clamping jaw member, said cooperating clamping shear blade member and clamping jaw member being formed with two cooperating thread clamping surfaces at least one of which is fluted, the fluting thereof increasing and becoming coarser in direction toward the tip of the respective clamping member whereon it is formed.

6. Tying device according to claim 5 wherein the fluting is in the form of teeth.

7. Tying device according to claim 5 wherein the fluted thread clamping surface is formed on said stationary clamping jaw member.

* * * * *